US005357721A

United States Patent [19]

Alvarez

[11] Patent Number: 5,357,721

[45] Date of Patent: Oct. 25, 1994

[54] ADJUSTABLE BEAM HOLDER

[76] Inventor: Gustavo O. Alvarez, 1705 W. 42 St. #102, Hialeah, Fla. 33012

[21] Appl. No.: 171,497

[22] Filed: Dec. 22, 1993

Related U.S. Application Data

[63] Continuation-in-part of Ser. No. 10,046, Jan. 28, 1993, Pat. No. 5,335,470.

[51] Int. Cl.[5] ..... E04B 1/38

[52] U.S. Cl. ..... 52/92.2; 52/93.2; 52/272; 52/295; 52/699; 52/708; 52/710; 52/713

[58] Field of Search ..... 52/698, 699, 702, 704, 52/706, 708, 710, 713, 92.1-93.2, 272, 295

[56] References Cited

U.S. PATENT DOCUMENTS

| | | | |
|---|---|---|---|
| 827,613 | 7/1906 | Brown | 52/707 |
| 1,599,335 | 9/1926 | Levens | 52/92.1 |
| 1,657,441 | 1/1928 | Huovinen | 52/92.2 |
| 2,947,119 | 8/1960 | Puckett | 52/713 |
| 3,000,145 | 9/1961 | Fine | 52/713 |
| 5,303,520 | 4/1994 | Gozdziak | 52/92.2 |

*Primary Examiner*—Carl D. Friedman
*Assistant Examiner*—Robert Canfield
*Attorney, Agent, or Firm*—J. Sanchelima

[57] ABSTRACT

An adjustable beam holder to be used with parallel spaced apart forming boards. The holder includes an elongated case with a longitudinal and centrally disposed slot that receives an elongated removably mounted connector member with an elongated protruding platform member on one side and the opposite side having perpendicularly mounted walls that are removably attached to the slot. Headed threaded shank members are inserted inside the case through openings defined by removable tabs formed on removable cap members mounted to the ends of the case. Readily detachable arms are mounted to the connector mounted to the case member in order to rest over the edges of forming wall and thereby aligning the upper wall flush with the plane defined by the upper edges.

5 Claims, 2 Drawing Sheets

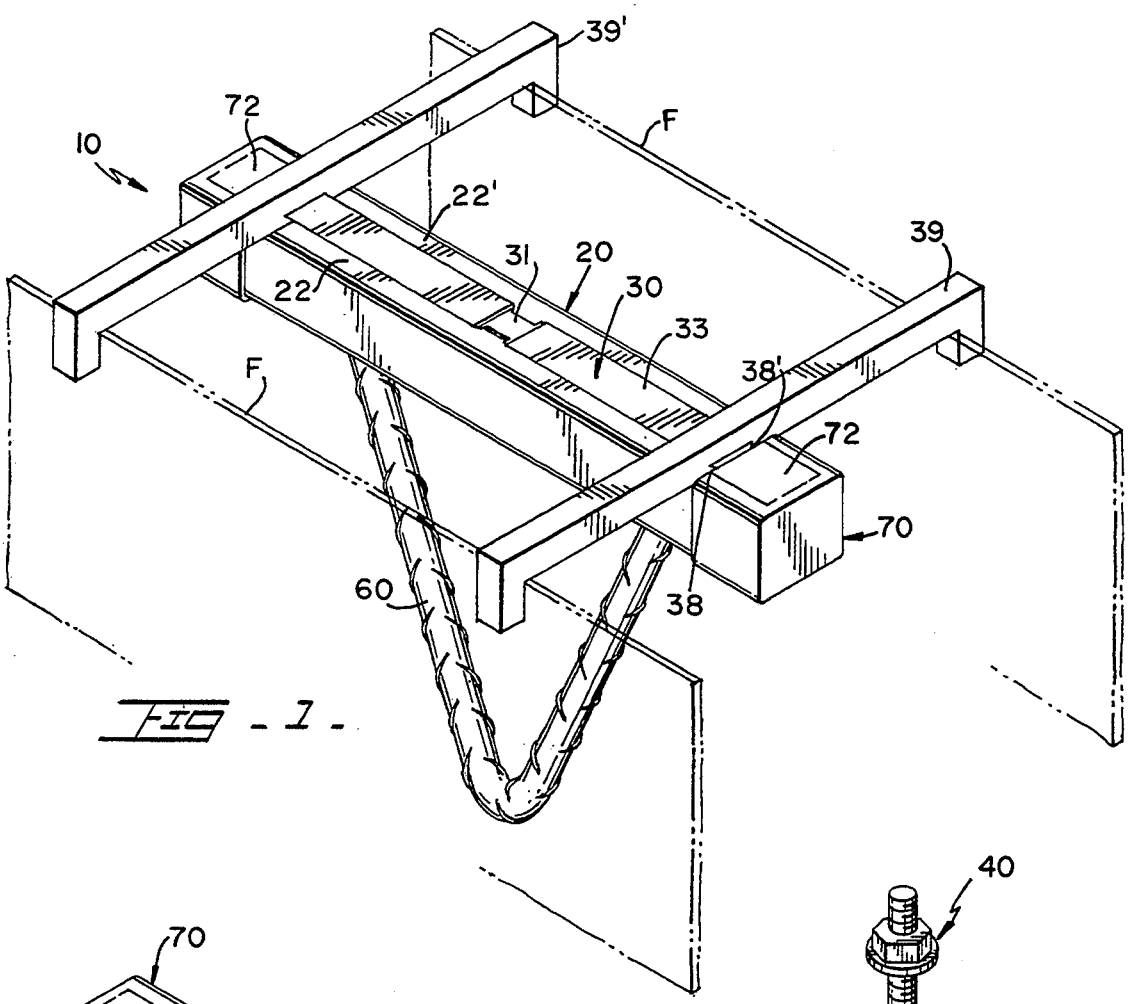
FIG - 1 -
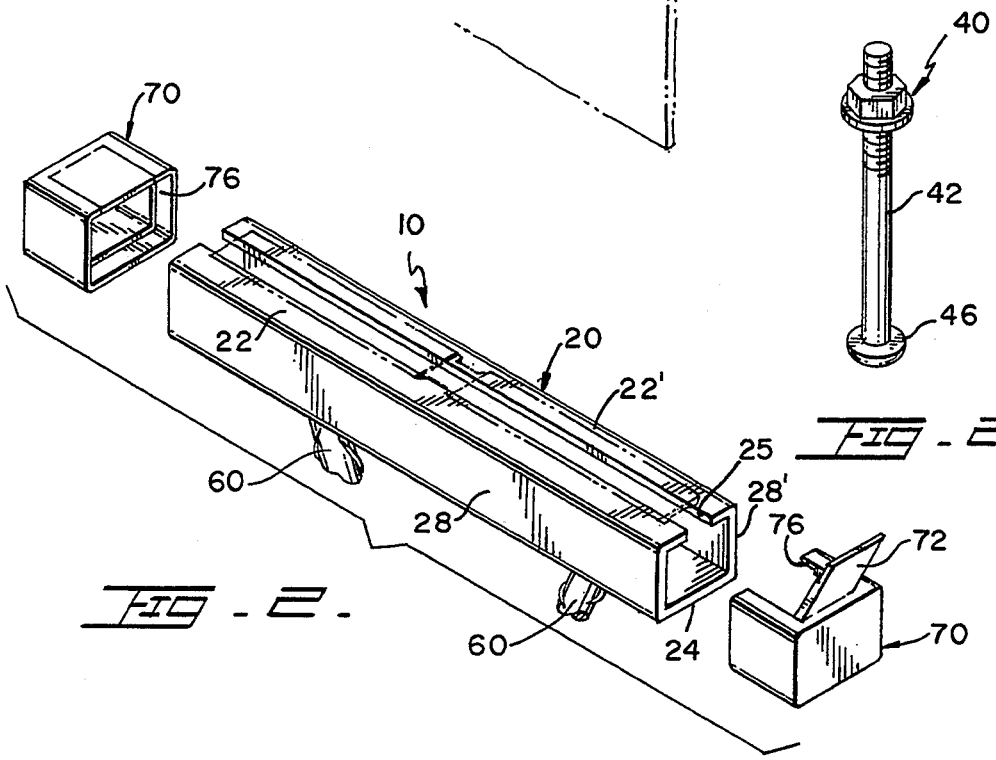
FIG - 2 -
FIG - 2A -

ADJUSTABLE BEAM HOLDER

The present application is a continuation-in-part (allowed) pending of U.S. patent application Ser. No. 08/010,046, filed on Jan. 28, 1993, now U.S. Pat. No. 5,335,470, issued Aug. 9, 1994, which is hereby incorporated by reference.

BACKGROUND OF THE INVENTION

1. Field of the Invention.

The present invention relates to beam holders, and more particularly, to those that are imbedded in concrete slabs or tie beams to anchor truss members.

2. Description of the Related Art.

Several devices have been designed in the past to operate as anchors in concrete for other construction members or fixtures. However, none of them have been directed to the typical wooden trusses of a roof. The acts of God, in particular hurricanes, have proven to cause damages not imaginable as the wind forces are difficult to predict. The need to keep the truss members in place has become quite apparent in South Florida with the recent hurricane Andrew.

The above referenced patent application provided a break through for beam holders as anchorage devices for trusses. However, the present device overcomes problems found in the production line and in the field, bring a faster solution to the users which in turn is translated into savings.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device for readily installation on the forms of a tie beam to be poured so that it can be readily adapted to receive and anchor the members of a truss thereby forming a rigid assembly.

It is another object of this present invention to provide a device that can be adjusted to different dimensions of truss members and different angles of these members.

It is still another object of this present invention to provide a device that can be used single handedly by a user.

It is still another object of this invention to provide a device wherein the detachable arm members are integrally built and removable mounted to the elongated tubular case.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an isometric view of the adjustable beam holder subject of the present application.

FIG. 2 shows an isometric view of the elongated tubular case member used in one of the preferred embodiments with a partial representation of the anchorage member and the end caps removed.

FIG. 2A shows a threaded shank.

DETAILED DESCRIPTION OF THE PREFERRED EMBODIMENT

Figure 3:
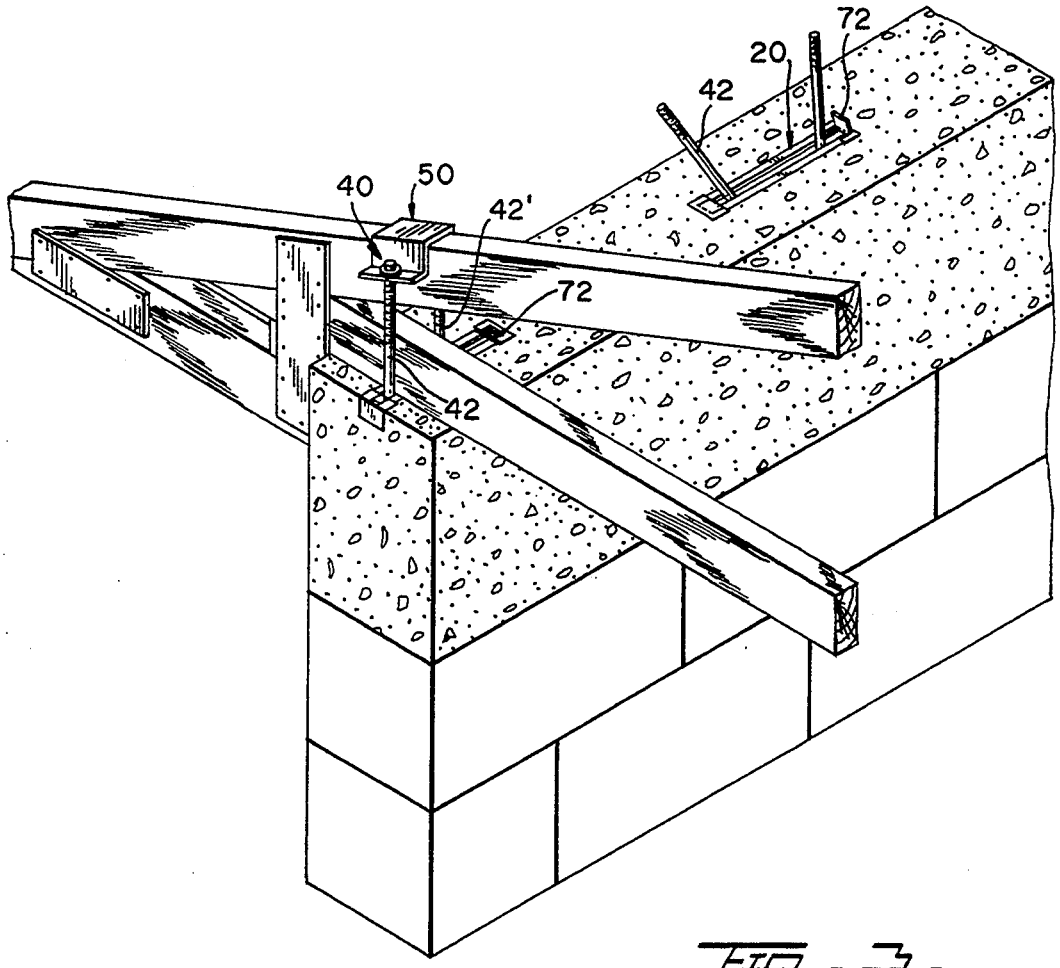
FIG. 3 illustrates an isometric view of the present invention used in one of the preferred embodiments to anchor one of the truss members.

Referring now to the drawings, where the present invention is generally referred to with numeral 10, it can be observed that it basically includes an elongated tubular case 20 with a longitudinal slot 25 on its top walls 22 and 22' defining a C-shaped cross-section. Case 20 includes top walls 22, 22'; bottom 24 and lateral walls 28 and 28' that define a space therein.

Figure 4:
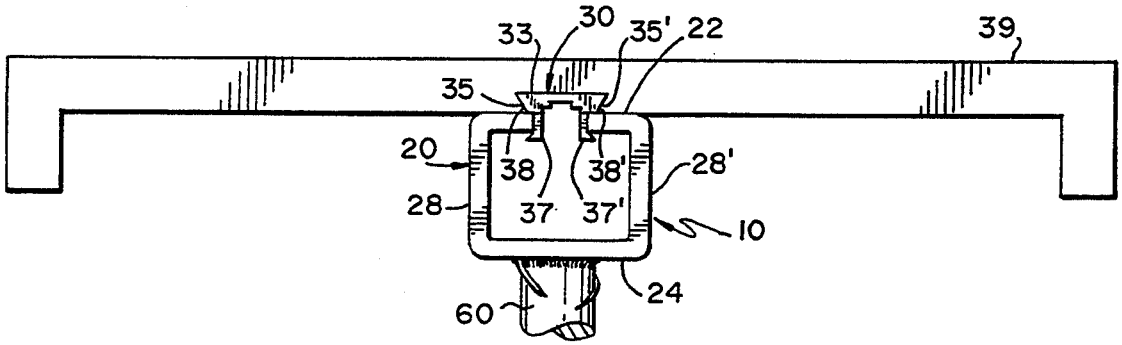
FIG. 4 is an end view of the elongated tubular member, without the end caps, and showing the detachable arm members mounted to the centrally mounted connector.

Elongated connector 30 is removably mounted to slot 25. Connector 30 includes elongated platform 33 that has an outwardly extending wall 35 and 35' forming a triangular cross-section as best seen in FIG. 4. Extending from platform 33 there are two walls 37 and 37' perpendicularly mounted thereon and kept at a spaced apart and parallel relationship with respect to each other. Walls 37 and 37' are preferably non-continuos in order to increase flexibility. That is, walls 37 and 37' do not extend longitudinal the entire length of case 20. Walls 37 and 37' snugly fit in slot 25 by sliding connector 30 from one of the two ends of connector 30. It is also possible to insert either wall 37 or 37' through slot 25 and then forcing the other wall 37' or 37 inside slot 25. Platform 33 protrudes outwardly from case member 20.

Detachable arm members 39 and 39' are removably mounted to connector 30, as best seen in FIGS. 1 and 4. Arm members 39 and 39' extend transversely across case 20 a sufficient distance to hang over the upper edges of forms F, as best seen in FIG. 1. In this manner, upper walls 22 and 22' are positioned flush with the upper surface of the concrete to be poured. Arms 39 and 39' include centrally disposed triangular cutouts 38 and 38' that cooperatively and removably receive platform 33. Also, depression 31 in the central portion of connector 30 permit the insertion of cut-outs 38 and 38' so that it can be subsequently slid to a desired position along connector 30. Connector 30, in the preferred embodiment is made out of a resilient plastic material which is inexpensive. It can also be made out of metal.

Fastening assemblies 40 include threaded shanks 42 and 42', with two ends as best seen in FIG. 2A. Shanks 42 and 42' extend a sufficient distance to permit it to pass through holes in clamp assembly 50, as best seen in FIG. 3. The other ends of shanks 42 and 42' have headed termination 46 that are inserted inside case 20 through opening 76 in cap member 70. Fastening assemblies 40 slide along slot 25. Flap 72 covers opening 76 during the pouring of the concrete to prevent the latter from coming inside case 20. When installed, flap 72 is aligned over slot 25, at the end of case member 20. After the concrete is poured, connector 30 and arm members 39 and 39' are removed since the engagement of walls 37 and 37′ to slot 25 is not as strong as the engagement of platform 33 with cut out 38 and 38′, the entire combination (arm members 39 and 39′ and connector 30) is removed at once when a user hits upwardly at the ends of arm members 39 and 39′. Then flap member 72 is opened, if needed with a pointed instrument, to permit head 46 of fastening assembly 40 in. The corresponding truss is then placed over case member 20, and the other fastening assembly 40 is inserted.

Anchorage member 60 is rigidly mounted to the bottom of case 20 on wall 24, and extend outwardly therefrom to provide a sufficient structural body that will be submerged under the poured concrete thereby providing the necessary anchorage function. Different designs for anchorage member 60 are suitable.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An adjustable beam holder adapted to be used with parallel spaced apart forming boards having upper edges aligned with respect to each other to define a plane and said holder being adapted to securely hold a truss assembly having a plurality of beams, comprising:

A) an elongated case member having two ends and said case member being defined by top, lateral and bottom walls defining a space therein and said top wall includes a longitudinally extending slot that extends from end to end;

B) elongated connector means removably mounted to said slot and including protruding a platform member;

C) at least two detachable arm members transversely and removably mounted to said connector means and said detachable arm members adapted to rest over the upper edges of said forming boards and said detachable arm members further including means for removable engagement to said protruding platform member;

D) anchorage means rigidly mounted to said bottom wall and said anchorage means extending perpendicularly and away from said bottom wall;

E) clamp means adapted to engage one of said beams of said truss assembly; and

F) fastening means for urging said clamp means towards said case member and said fastening means being removably and slidably mounted to said case member.

2. The adjustable beam holder set forth in claim 1 further including:

G) cap members removably mounted to the ends of said elongated case member.

3. The adjustable beam holder set forth in claim 2 wherein said elongated connector means includes a plurality of wall members perpendicularly mounted to said protruding platform means and adapted to be removably mounted to said slot.

4. The adjustable beam holder set forth in claim 3 wherein said cap members include each tab members cooperatively aligned over said slot so that removal of said tab members permits the insertion of said fastening means in said case member.

5. The adjustable beam holder set forth in claim 4 wherein said connector means includes a centrally disposed cut-out for cooperative removable mounting to said slot.

* * * * *